United States Patent [19]

Crafton

[11] Patent Number: 4,741,239

[45] Date of Patent: May 3, 1988

[54] SECUREMENT NET-WORK CONFIGURATION FOR HOLDING MUSICAL INSTRUMENT PICKS

[76] Inventor: Charles R. Crafton, 4022 Deerlick Rd., Lewisburg, Ky. 42256

[21] Appl. No.: 16,190

[22] Filed: Feb. 17, 1987

[51] Int. Cl.[4] ..... G10D 3/16
[52] U.S. Cl. ..... 84/322
[58] Field of Search ..... 84/322

[56] References Cited

U.S. PATENT DOCUMENTS

| | | | |
|---|---|---|---|
| 3,650,172 | 3/1972 | Osborne | 84/322 |
| 4,102,234 | 7/1978 | Brundage | 84/322 |
| 4,122,746 | 10/1978 | Freeman | 84/322 |

*Primary Examiner*—Lawrence R. Franklin

[57] ABSTRACT

A pick for a stringed musical instrument having a fingernail shaped body, an annular band secured to the front face of the lower portion of the body, and a strip secured to the back face of the upper portion of the body, the strip criss-crossing intermediate the body and having ends secured to the band. The band and the strip are made of a stretchable material such as rubber.

9 Claims, 2 Drawing Sheets

FIG. 3
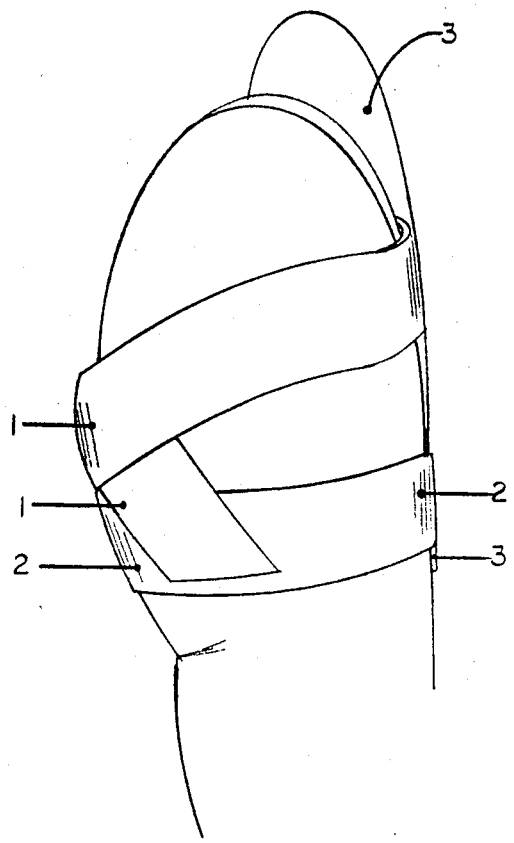
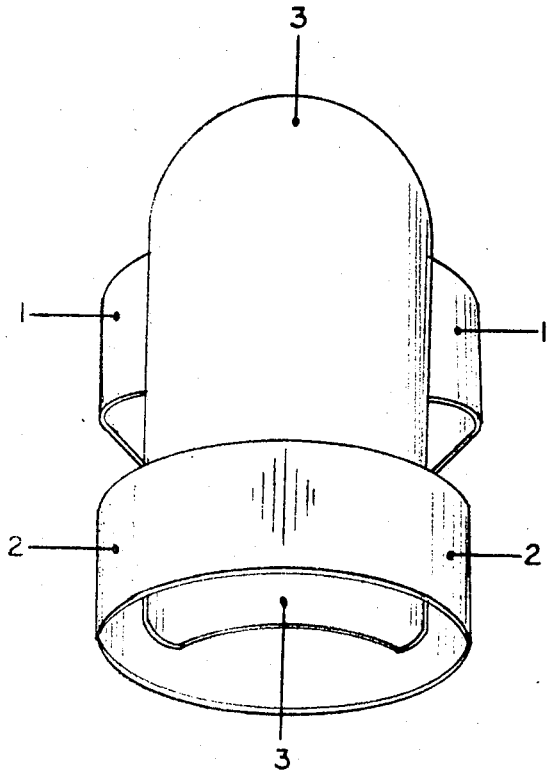
FIG. 4

SECUREMENT NET-WORK CONFIGURATION FOR HOLDING MUSICAL INSTRUMENT PICKS

BACKGROUND OF THE INVENTION

1. Field of the Invention

This invention relates to a device for plucking the strings of a musical instrument.

2. Description of the Prior Art

Finger/thumb picks are worn on the end of the finger or thumb of a musician and are used for plucking the strings of a musical instrument.

A problem is encountered by musicians with finger picks currently in use in which the pick part is worn underneath the finger instead of on top as is the natural nail of the finger. This type pick gives a disoriented attack of the strings. Also, it is impossible to play down strokes (striking the strings downwardly away from the musician), since any attempt to do so will pull the pick backwards.

Thumb picks currently in use allow only down strokes. The musican can only use the front of the pick; any attempt to use the back of the thumb pick is apt to snag the pick in the strings and/or rotate the pick about the thumb.

Both finger and thumb picks have a tendency to bind and pinch.

This invention eliminates these problems.

SUMMARY OF THE INVENTION

The invention relates to a finger/thumb pick for a stringed musical instrument, such as a guitar, and a means for securing the pick to the musician's finger or thumb. The pick is shaped similar to a human fingernail and is worn on the finger over the fingernail.

One object of the invention is to provide a finger/-thumb pick having a securement network with proper pressure points for attaching the pick to the user securely.

Another object is a pick having a natural and comfortable feel.

BRIEF DESCRIPTION OF THE DRAWINGS

FIG. 3 is a side view of the pick on a finger.

FIG. 4 is a front view of the assembled pick.

DESCRIPTION OF THE PREFERRED EMBODIMENT

Figure 1:
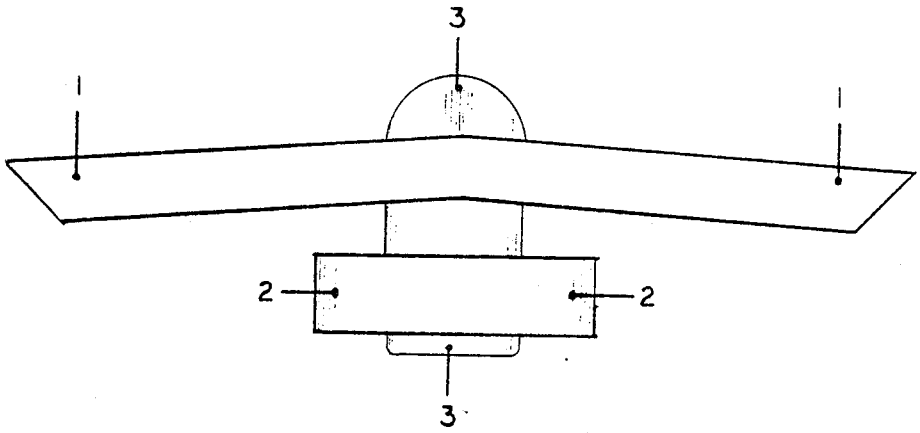
FIG. 1 is a back view of the components of the pick prior to completion of assembly.

As shown in FIG. 1, the pick of the instant invention has three parts or elements: a rubber strip 1, an annular rubber band 2, and a pick body 3.

The pick body 3 may be made of any suitable pick material, such as plastic or metal. The pick body 3 is shaped similar to a human fingernail, the underside of which is shaped to conform to the shape of the finger or thumb on which it is to be used.

The rubber strip 1 is secured by gluing or any other suitable means to the center of the upper portion of the back of the pick body, as shown in FIG. 1. The strip 1 diverges downwardly and away from the pick body. The strip may be manufactured to provide the divergence or it may be cut transversely of the strip at the point it is secured to the pick body 3 and separated, forming a pie shaped gap between the strip ends, not shown.

Annular band 2 is secured to the front face of pick body 3 with the major portion of the band extending behind the pick, as most clearly shown in FIG. 4.

When manufactured, the pick should be stretched on a finger/thumb form having the shape and proper dimensions of the finger or thumb for which the pick is designed. The picks may be made in sizes of small, medium, and large, although because the securement network is stretchable, one size will fit many different fingers or thumbs.

Figure 2:
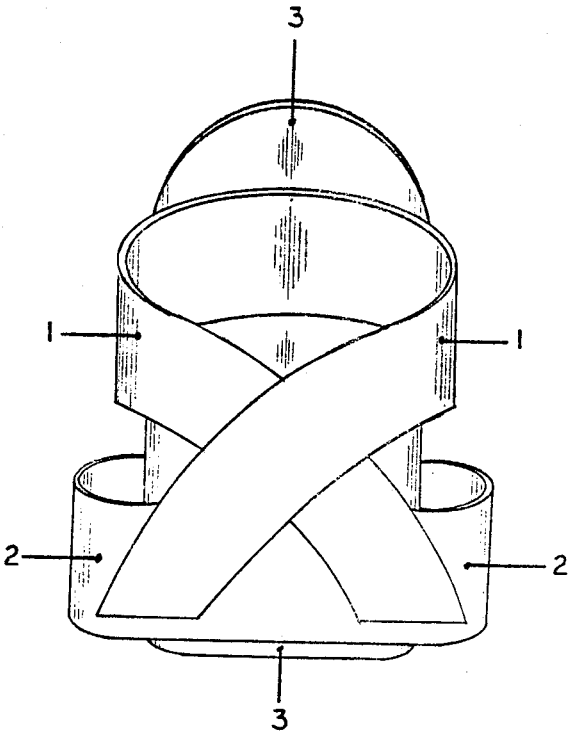
FIG. 2 is a back view of the pick after assembly.

When on the finger/thumb form, the ends of strip 1 will be gently pulled taut around the form and criss-crossed to form an intersection such as is shown in FIG. 2. Strip 1 is secured (glued or vulcanized, etc.) together at the intersection. Band 2 should be pulled down out of the way to allow the intersection without interference. Once the intersection is secured, the ends of strip 1 below the intersection are brought down so as to overlap band 2 in the manner shown in FIG. 2. The ends are further gently pulled taut and secured to band 2. When secured, the upward pull of the lower ends of strip 1 will pull band 2 upward to its proper position. The assembled pick will have the intersection and band oriented such that they will be located on the finger as shown in FIG. 3.

I claim:

1. A pick for a stringed musical instrument comprising:
   - a pick body having the general shape of a human fingernail; and
   - a securement network consisting of:
   - an annular, stretchable band secured to the lower portion of said pick body, said band forming a finger receiving loop extending behind said pick body; and
   - a stretchable strip attached to the upper portion of said pick body, said strip diverging downwardly from said pick body, criss-crossing intermediate the length of said pick body, and having two ends secured to said band.

2. A pick as in claim 1 wherein said band is secured to the front face of said pick body and said strip is secured to the back face of said pick body.

3. A pick as in claim 1 wherein said pick body is made from plastic or metal.

4. A pick as in claim 1 wherein said strip is gently pulled taut prior to being secured both at said intersection and to said band.

5. A pick as in claim 4 wherein said pick is assembled on a form having the shape and dimensions of a finger or thumb, said pick body being placed on said form with said strip being gently stretched around said form prior to being secured at said intersection and to said band.

6. A pick as in claim 5 wherein said form and said pick are manufactured in a plurality of sizes.

7. a pick as in claim 6 wherein said sizes are three, small, medium, and large.

8. A pick as in claim 1 wherein said criss-crossing of said strip forms an intersection, said strip being secured together at said intersection.

9. A pick as in claim 8 wherein said band and said strip are made of rubber.

* * * * *